United States Patent [19]

Martinet

[11] 4,306,769

[45] Dec. 22, 1981

[54] INTERIOR ILLUMINATION APPARATUS USING SUNLIGHT

[76] Inventor: Michael E. Martinet, 10315 Hester Ave., Whittier, Calif. 90603

[21] Appl. No.: 138,539

[22] Filed: Apr. 9, 1980

[51] Int. Cl.[3] ..... B02B 17/00

[52] U.S. Cl. ..... 350/264

[58] Field of Search ..... 353/3; 350/258–264; 52/22, 18, 80, 200

[56] References Cited

U.S. PATENT DOCUMENTS

| | | | |
|---|---|---|---|
| 494,299 | 3/1893 | Lugrin | 350/264 |
| 550,376 | 11/1895 | Lugrin | 350/264 |
| 585,770 | 7/1897 | Lugrin | 350/264 X |
| 668,404 | 2/1901 | Hanneborg | 350/264 |
| 729,660 | 6/1903 | Poulson | 350/264 |
| 1,037,668 | 9/1912 | Schwickart | 350/264 |
| 1,254,520 | 1/1918 | MacDuff | 350/259 |
| 2,022,144 | 11/1935 | Nicolson | 353/3 |
| 3,157,089 | 11/1964 | Menefee | 350/258 |
| 3,511,559 | 5/1970 | Foster | 350/264 X |
| 4,040,725 | 8/1977 | Goodbar | 350/263 |

*Primary Examiner*—Richard A. Wintercorn

*Attorney, Agent, or Firm*—Smyth, Pavitt, Siegemund & Martella

[57] ABSTRACT

An apparatus for collecting sunlight and directing the collected sunlight into the interior of the building to provide illumination, so that the energy used for artificial illumination can be conserved, includes a collector, a light pipe, and a diffuser. The collector includes an immovable flared trumpet-like hollow tube having a highly reflective interior surface and having its larger aperture oriented to maximize the sunlight received at a particular time of day. The larger aperture is closed by a transparent cap which supports a secondary reflector that extends forward of the larger aperture. The secondary reflector serves to reflect into the hollow tube light travelling at a low angle of incidence with respect to the larger aperture to compensate for the reduced efficiency of the larger aperture to low-angle light. The apparatus also includes a sprinkler for washing dust and other deposits from the transparent cap, and further includes a servo-controlled light valve for maintaining, to the extent possible, a constant level of illumination at a work station within the building.

14 Claims, 4 Drawing Figures

INTERIOR ILLUMINATION APPARATUS USING SUNLIGHT

BACKGROUND OF THE INVENTION

1. Background of the Invention

The present invention is in the field of building illumination and particularly relates to an improved skylight for collecting sunlight and directing it into the interior of the building for illumination purposes.

2. The Prior Art

It is possible to characterize the prior art inventions broadly as including a collector for receiving and redirecting the sunlight, a tube or duct for conducting the light to the interior of a building, and a diffuser for producing a more uniform distribution of light within the building. Patentability appears to result from novel designs for each of the elements, and combinations thereof. U.S. Pat. No. 1,254,520 issued Jan. 22, 1918 to MacDuff is typical of the prior art. MacDuff shows a globular light collector oriented vertically and mounted on the roof of a building. The inner surface of the globular light collector includes prismatic elements, and the light is said to be collimated by a circular concave reflector, a convex circular mirror, and rectifying lenses. The collimated light is directed through the ducts in which plane mirrors are used to reflect the light where the direction of the duct changes. A diffusing lens and a fixture are used to spread the beam into many directions within the room to be illuminated.

A similar system is shown in U.S. Pat. No. 3,551,559 issued May 12, 1970 to Foster. The collector used by Foster is oriented vertically and produces a collimated beam of light, but the design of the collector is quite different from that used by MacDuff. Foster also uses plane mirrors in a duct to direct the collimated light to a diffuser. The diffuser used by Foster is different from that used by MacDuff, and it directs the light toward the ceiling of the room to be illuminated to provide an indirect lighting.

In U.S. Pat. No. 668,404 issued Feb. 19, 1901, Hanneborg shows a conical reflector oriented vertically into which direct sunlight is reflected by a large plane mirror that can be manipulated by an operator located in the interior of the building. Hanneborg makes no attempt to collimate the light, which is passed by multiple reflections through a tube to a diffuser.

A fuller discussion of these and other patents is included in the Prior Art Statement filed concurrently with the present application and included within the present file. As will presently be seen, the present invention is simpler than the inventions known in the prior art and at the same time is more efficient.

SUMMARY OF THE INVENTION

Unlike some of the prior art systems which use a sun-tracking collector, the present invention obviates the need for such complexities. Other collectors used in the prior art were oriented vertically, and consequently, the effective area presented for receiving sunlight was only a fraction of the total area of the collector, except at noontime of the equator. In contrast, in the present invention, the collector is not oriented vertically, but is oriented towards that portion of the sky that is brightest at the time when the illumination is needed. This assures that the maximum collector area is presented to the major source of the light. In the particular embodiment of the invention, the collector is immovably mounted with the receiving aperture oriented to the average position of the sun at noon.

In this embodiment, the diminution of the projected receiving area in the direction of the sun at morning and evening is at least partially compensated by the action of a secondary reflector that is mounted in front of the receiving aperture and that is effective during the morning and evening hours to reflect sunlight into the receiving aperture of the collector. In this manner, the collector of the present invention maintains a more nearly constant level of illumination during the day, and particularly during the early morning and late afternoon hours. The secondary reflector is effective during the midday hours to cast a shadow on the receiving aperture, thereby both moderating the excessive sunlight received during those hours, and reducing the amount of direct sunlight from falling into the distribution duct.

The collector design used in the present invention provides a large collecting area in relation to the actual opening in the roof, and this helps to maintain the illumination, even on the overcast days.

In one embodiment of the present invention, there is provided a sprinkler head adjacent the cap which covers the receiving aperture, to permit dust and other deposits to be washed from the cap conveniently.

These and other objects and advantages of the present invention will be seen more clearly in the detailed description given below, in which reference is made to the accompanying drawings. However, the drawings are for the purpose of illustration and description only, and are not intended as a limitation on the scope of the invention.

DETAILED DESCRIPTION OF THE PREFERRED EMBODIMENTS

Figure 1:
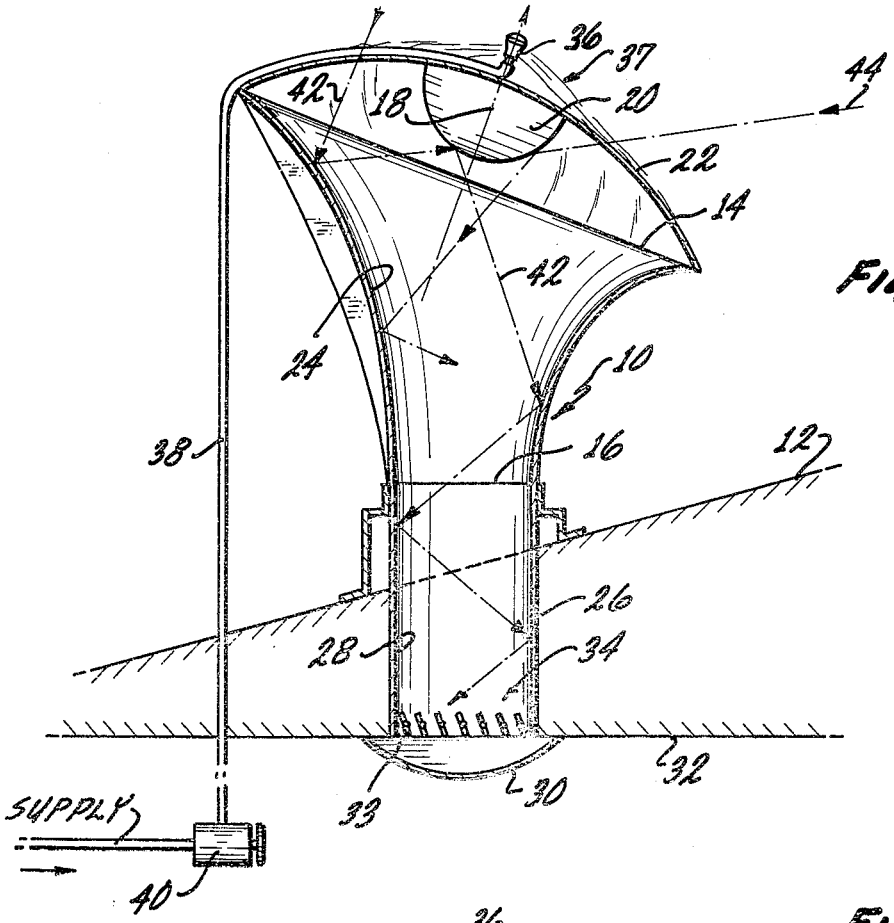
FIG. 1 is a diagram showing a side elevation cross-sectional view of a preferred embodiment of the apparatus of the present invention.
Figure 2:
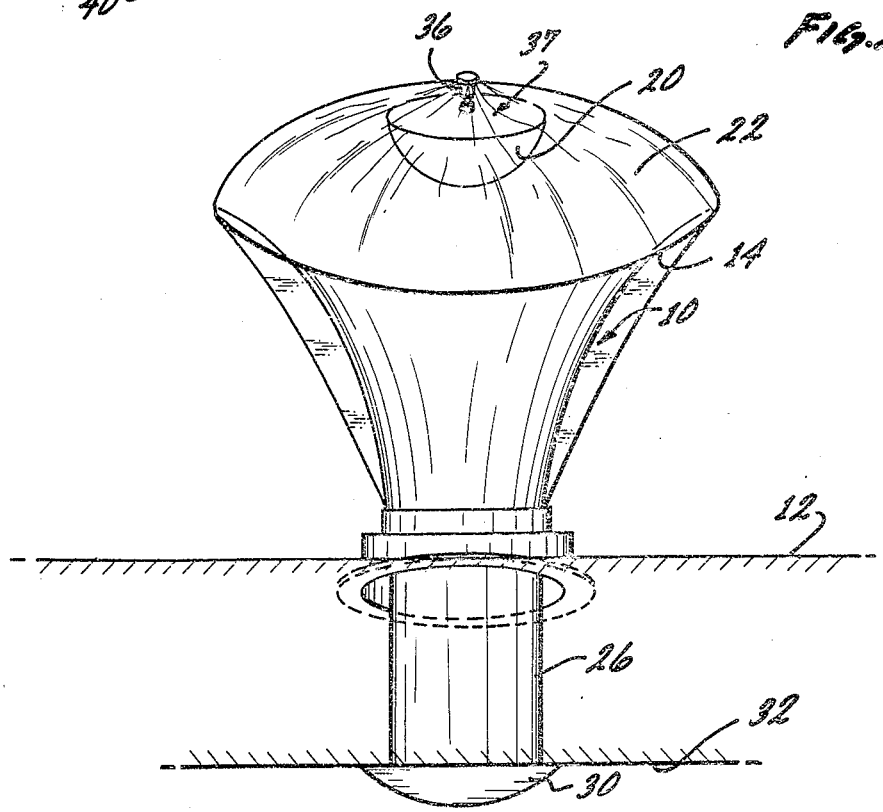
FIG. 2 is a diagram showing a front elevation view of the apparatus of FIG. 1.
Figure 3:
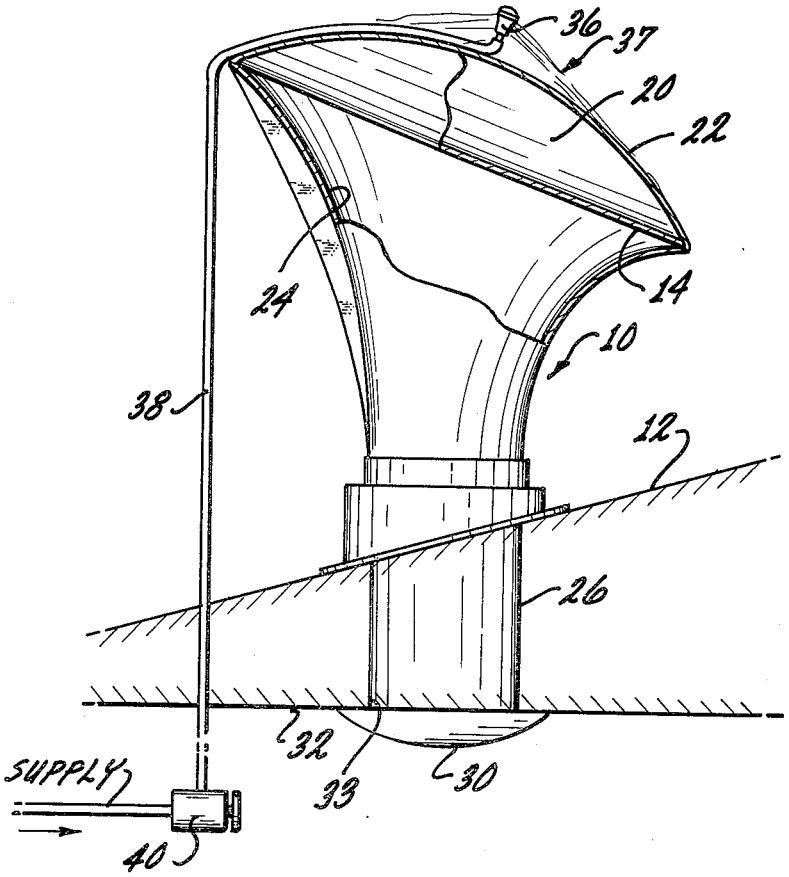
FIG. 3 is a diagram showing a side elevation cross-sectional view of an alternative embodiment of the present invention; and, FIG. 4 is a diagram showing a front elevation view of the alternative embodiment illustrated in FIG. 3.
Figure 4:
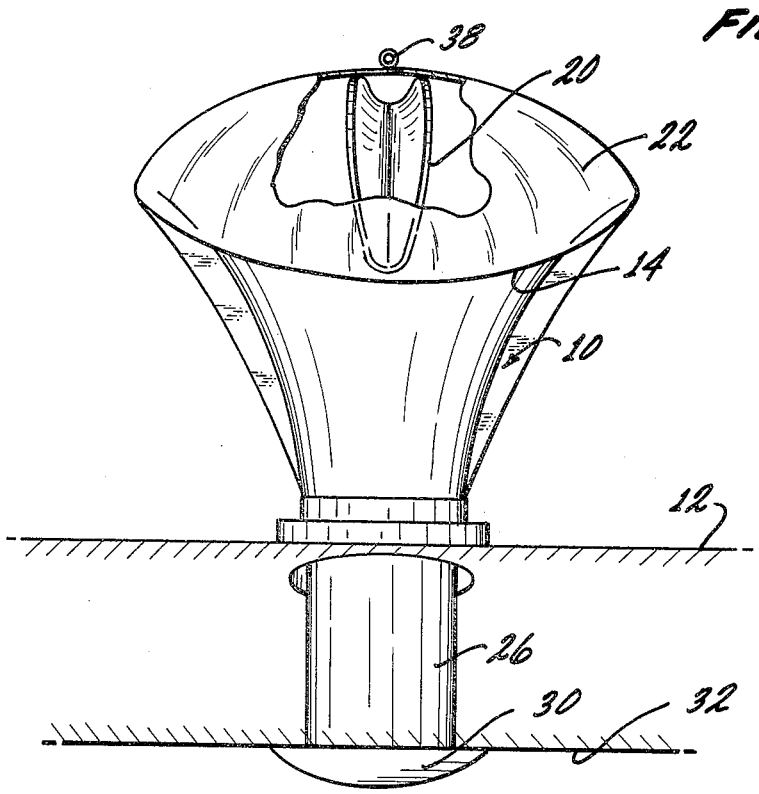

Turning now to the drawings, in which similar parts are denoted by the same reference numeral throughout, a preferred embodiment of the invention is shown in FIG. 1 and 2, while an alternative embodiment of the invention is shown in FIGS. 3 and 4. The apparatus includes a hollow tube 10 which is immovably mounted to the roof 12 of a building, and which has a trumpet-like flared shape. The hollow tube 10 includes a larger rim 14 which defines and bounds a larger aperture through which sunlight is received, and further includes a smaller rim 16 which defines and bounds a smaller aperture through which collected light is directed toward the interior of the building.

A direction is assigned to the larger aperture and is defined as the direction perpendicular to the aperture, as indicated by the arrow 18. In the preferred embodiment, the hollow tube is shaped so that the larger aperture is oriented in a preselected fixed direction 18. The preselected fixed direction 18 is chosen to maximize the flow of direct sunlight through the larger aperture during a particular part of the day. In the preferred embodiment shown in FIG. 1, the preselected fixed direction 18 is chosen to maximize the flow of direct sunlight through the aperture during midday, and accordingly, the arrow 18 points approximately to the position of the sun at noon on the shortest day of the year.

This is not the only permissible orientation for the larger aperture. Suppose, for example, that a building has western exposure, and accordingly, no need for the present invention in the late afternoon. In such as case, the larger aperture could be preselected to coincide with the position of the sun in the early morning hours. The orientation of the larger aperture is established when the hollow tube 10 is affixed to the roof 12, and thereafter, the hollow tube is immovable with respect to the roof 12.

The larger aperture is closed by a transparent cap 22 which is affixed to the larger rim 14. The cap 22 supports a secondary reflector 20 at a position in front of the larger aperture; that is, outside of the hollow tube 10 and between the larger aperture and the sun.

The inside surface 24 of the hollow tube 10 is highly reflective. In a preferred embodiment, this is achieved by covering the surface with aluminum foil, although in other embodiments, the hollow tube may be formed of a metal and its inside surface 24 may be polished. Likewise, the secondary reflector 20 may be made highly reflective.

The secondary reflector 20 serves three main purposes. First, it is instrumental in reflecting light into the hollow tube. Second, the secondary reflector tends to prevent sunlight from passing directly through the smaller aperture. Third, the secondary reflector 20 serves to capture light travelling at low angles of incidence with respect to the larger aperture.

This is illustrated by the rays 42 and 44 shown in FIG. 1. The ray 42 is travelling at a large angle of incidence with respect to the plane of the larger aperture, and first strikes the inside surface 24 of the hollow tube 10. Upon reflection from the inside surface 24, the ray 42 is reflected from the secondary reflector 20 into the hollow tube 10 so as to pass through the smaller aperture. The shadow cast by the secondary reflector 20 tends to prevent light rays from passing directly through the smaller aperture without reflection.

The ray 42 of FIG. 1 is typical of the rays received during midday, and during that portion of the day, the larger aperture receives maximum illumination because of its orientation. However, in the early morning and late afternoon hours, the area of the larger aperture, when projected in the direction of the sun, is considerably less, and therefore the total quantity of light collected by the hollow tube 10 is reduced at those hours. During these hours, the rays of sunlight have a lower angle of incidence, typified by the ray 44 of FIG. 1, and it is seen that the location of the secondary reflector 20 in front of the larger aperture enables the secondary reflector to help to collect rays having low angles of incidence. This, in turn tends to compensate for the reduced effectiveness of the hollow tube 10 in collecting light at those hours. Although the use of the secondary reflector 20 to direct light rays reflected from a primary reflector is well known in optics, i.e., the Schmidt-Cassegrain System, elaborate precautions are usually taken in such systems to prevent extraneous light from being reflected into the system from the secondary reflector. In contrast, in the present invention such reflection is encouraged as a means for augmenting the amount of light collected when the sun is at a lower angle of incidence with respect to the larger aperture.

A similar compensating effect is achieved by the structure of the present invention with respect to the yearly cycle. Thus, the ray 42 may be thought of as representing the direction of light from the sun in summer when the sun at noon is high in the sky, while the ray 44 may be thought of as representing the situation in winter when the sun is lower in the sky. Thus, it is seen that the present invention includes means for compensating the collecting ability of the hollow tube 10 for both the diurnal and the annual cycles to provide a more uniform flow of light through the smaller aperture.

In a preferred embodiment, a light pipe 26 is attached to the smaller rim 16 of the hollow tube 10, and the inside surface 28 of light pipe 26 is also highly reflective. The light passing through the smaller apertures is not collimated, and the various rays pass through the light pipe 26 at various angles, typically being reflected from the walls of the light pipe a number of times.

The reflective surfaces in the apparatus of the present invention do not have to be polished to optical quality smoothness, because the apparatus does not attempt to form any images. On the contrary, images would be undesirable, since the object is to illuminate the diffuser 30 with as uniform a distribution of light as is possible. For this reason, the multiple reflection from the relatively rough, but highly reflective surfaces have the desirable effect of diffusing the light and thereby producing a more uniform distribution.

The light pipe 26 conducts the light towards the interior of the building, and typically terminates near the ceiling 32 of a room within the building. The lower rim 33 of the light pipe 26 is covered with a cap 30 which, in a preferred embodiment, consists of frosted glass, and which diffuses the incident light in all directions. In other embodiments the cap 30 may consist of a transparent material. In a preferred embodiment, a plurality of slats 34 are included within the light pipe 26 to permit the level of illumination to be reduced under control of an operator. The slats 34 move in unison in a manner comparable to the slats of a venetian blind.

To insure that the transparent cap 22 does not become occluded with dust and other deposits, in the preferred embodiment, a sprinkler head 36 is provided for directing a spray 37 of water, or other suitable fluids onto the cap 22 to flush the undesirable material from its surface. The flow of water in the pipe 38 is controlled by an operator through the use of the valve 40.

FIGS. 3 and 4 show an alternative embodiment in which the collector differs from that of FIGS. 1 and 2 in that the secondary reflector 20 is larger so as to provide a greater degree of compensation during those times when the sun is at a relatively low angle of incidence with respect to the larger aperture.

The hollow tube 10 is seen to have a slightly different shape in the embodiment of FIG. 3, compared with the embodiment of FIG. 1. Experimentation has shown that it is not necessary for the hollow tube to have any precise shape, in contrast with conventional imaging optical systems in which the surface shape must be maintained very accurately. It is sufficient for the present invention that the hollow tube 10 flares from the smaller aperture to the larger aperture, and that the plane of the larger aperture is tilted with respect to the smaller aperture, as shown in the drawings.

In other embodiments wherein a constant level of illumination is not necessary, the secondary reflector can be omitted altogether or it may be replaced by an opaque area on the cap 22.

In the preferred embodiment, the slats 34 are controlled by a servo-mechanism which includes a photosensor located at the work station at which a constant illumination is desired. The servo-mechanism senses the existing illumination and adjusts the angle of the slats 34 to maintain a constant level of illumination as far as is possible. The servo-mechanism can also turn on one or more sources or artificial illumination when, as evening approaches, the natural illumination is inadequate.

Thus, there have been described in detail a preferred embodiment and an alternative embodiment of the invention. The apparatus of the prevent invention includes a collector whose entry aperture is oriented in a direction to maximize the light received at a particular time of day. The collector includes a flared trumpet-like hollow tube having a highly reflective interior surface, a transparent cap covering the larger aperture of the hollow tube, and supporting a secondary reflector at a position in front of the larger aperture. The secondary reflector is used, among other things, to deflect light arriving at low angles of incidence into the hollow tube to compensate for the reduced effective cross-sectional area of the larger aperture during certain times of the day. The apparatus also includes a light pipe for conducting the light in an uncollimated form into the interior of the building, and the apparatus further includes a diffuser to diffuse the light that has passed through the light pipe to provide a more uniform distribution of light. The apparatus further includes a sprinker head for flushing dust and other deposits from the transparent cap.

The foregoing detailed description is illustrative of several embodiments of the invention, and it is to be understood that additional embodiments thereof will be obvious to those skilled in the art. The embodiments described herein, together with those additional embodiments, are considered to be within the scope of the invention.

What is claimed is:

1. An apparatus for collecting sunlight and transmitting the collected light to the interior of a building or similar structure to reduce the need for artificial lighting, the improvement comprising:

a collector including a flared trumpet-like hollow tube having a larger rim defining a larger aperture for receiving direct sunlight, having a smaller rim defining a smaller aperture through which light received by the larger aperture is transmitted to the interior of the building, and having a highly-reflective inside surface, said hollow tube immovably mounted on the building with the larger rim inclined to a horizontal plane and with the larger aperture oriented in a preselected fixed direction to substantially maximize the flow of direct sunlight through the larger aperture during a particular part of the day.

2. The improvement of claim 1 wherein said collector further comprises a secondary reflector having a reflecting surface positioned at least partially in front of the larger aperture and generally facing the larger aperture to reflect into said hollow tube light incident at a larger angle with respect to the predetermined fixed direction.

3. The improvement of claim 2 further comprising a cap of a rigid material substantially transparent to sunlight covering the larger aperture of said collector and supporting said secondary reflector in front of the larger aperture.

4. The apparatus of claim 3 further comprising a sprinkler mounted adjacent said cap to apply under control of an operator a spray of fluid to said cap to flush dust and other deposits from said cap.

5. The improvement of claim 1 further comprising a diffuser covering the smaller aperture to diffuse the light passing through the smaller aperture.

6. The improvement of claim 1 further comprising a light pipe extending toward the interior of the building from the smaller rim of the hollow tube of said collector, said light pipe including highly reflective walls defining a duct through which uncollimated light is conducted and diffused by multiple reflections from said highly reflected cylindrical walls.

7. The improvement of claim 6 further comprising a diffuser covering the end of said light pipe farthest from said collector, to further diffuse the light that has been conducted through said light pipe.

8. The improvement of claim 1 further comprising a cap of material substantially transparent to sunlight covering the larger aperture of said collector.

9. Apparatus for collecting sunlight and transmitting the collected light to the interior of a building or similar structure to reduce the need for artificial lighting, said apparatus comprising:

a collector including a flared trumpet-like hollow tube having a larger rim defining a larger aperture for receiving direct sunlight, having a smaller rim defining a smaller aperture through which light received by the larger aperture is transmitted to the interior of the building, and having a highly reflective inside surface, said hollow tube immovably mounted on the building with the larger rim inclined to a horizontal plane and with the larger aperture oriented in a preselected fixed direction to substantially maximize the flow of direct sunlight through the larger aperture during a particular part of the day; and, a secondary reflector having a reflecting surface positioned at least partially in front of the larger aperture and generally facing the larger aperture to reflect into said hollow tube light incident at a large angle with respect to the predetermined fixed direction.

10. The apparatus of claim 9 further comprising a cap of a rigid material substantially transparent to sunlight covering the larger aperture of said collector and supporting said secondary reflector in front of the larger aperture.

11. The apparatus of claim 9 further comprising a sprinkler mounted adjacent said cap to apply under control of an operator a spray of fluid to said cap to flush dust and other deposits from said cap.

12. The apparatus of claim 9 further comprising a diffuser covering the smaller aperture to diffuse the light passing through the smaller aperture.

13. The apparatus of claim 9 further comprising a light pipe extending toward the interior of the building from the smaller rim of the hollow tube of said collector, said light pipe including highly reflective cylindrical walls defining a duct through which uncollimated light is conducted and diffused by multiple reflections from said highly reflective cylindrical walls.

14. The apparatus of claim 13 further comprising a diffuser covering the end of said light pipe farthest from said collector, to diffuse the light that has been conducted through said light pipe.

* * * * *